United States Patent [19]

Huang et al.

[11] Patent Number: 4,646,824

[45] Date of Patent: Mar. 3, 1987

[54] PATTERNS OF HORIZONTAL AND VERTICAL WELLS FOR IMPROVING OIL RECOVERY EFFICIENCY

[75] Inventors: Wann-Sheng Huang; Margaret A. Hight, both of Houston, Tex.

[73] Assignee: Texaco Inc., White Plains, N.Y.

[21] Appl. No.: 812,692

[22] Filed: Dec. 23, 1985

[51] Int. Cl.[4] ..... E21B 43/30

[52] U.S. Cl. ..... 166/52; 166/50; 166/245

[58] Field of Search ..... 166/245, 50, 52

[56] References Cited

U.S. PATENT DOCUMENTS

| | | | |
|---|---|---|---|
| 3,199,587 | 8/1965 | Santourian | 166/245 |
| 3,402,768 | 9/1968 | Felsenthal et al. | 166/245 |
| 4,022,279 | 5/1977 | Driver | 166/271 |
| 4,410,216 | 10/1983 | Allen | 166/245 X |
| 4,434,849 | 3/1984 | Allen | 166/50 X |
| 4,501,326 | 2/1985 | Edmunds | 166/50 X |
| 4,532,986 | 8/1985 | Mims et al. | 166/50 |

*Primary Examiner*—Stephen J. Novosad

*Attorney, Agent, or Firm*—Jack H. Park; Kenneth R. Priem; Harold J. Delhommer

[57] ABSTRACT

The disclosed invention is a method of recovering hydrocarbons by employing a modified 9 spot well pattern which contains a vertical central well, four vertical corner injection wells and four horizontal wells as the side wells in the pattern. The horizontal side wells are aligned on axes perpendicular to the substantially rectangular boundaries of the modified 9 spot well pattern or aligned on the axes between the four corner injection wells.

18 Claims, 10 Drawing Figures

PATTERNS OF HORIZONTAL AND VERTICAL WELLS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with modified 9 spot and 13 modified spot well patterns employing horizontal wells placed between vertical corner injection wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unusally large number of injection wells U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a method of recovering hydrocarbons from an underground formation by employing a modified 9 spot well pattern which contains a substantially vertical central well, four substantially vertical corner injection wells and four substantially horizontal wells as the side wells in the pattern. The horizontal side wells may be aligned in one of two directions. The horizontal wells may be aligned on axes perpendicular to the substantially rectangular or square boundaries of the modified 9 spot well pattern or the horizontal wells may be aligned on the axes between the four corner injection wells.

The invention pattern may also be expanded to a modified 13 spot pattern by the inclusion of four substantially vertical infill wells located between the central well and the corner wells.

DETAILED DESCRIPTION

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns.

The invention method provides a way of achieving horizontal well advantages by using substantially horizontal wells in conjunction with substantially vertical wells for improving oil recovery efficiency. The invention requires that four substantially horizontal wells be drilled as the side wells between the four substantially vertical corner injection wells. These substantially horizontal wells may be drilled so that their length is aligned in either of two directions in the pattern. The modified 9 spot pattern may contain the four horizontal side wells aligned on axes perpendicular to the substantially rectangular boundaries of the modified 9 spot well pattern or in such a manner that the length of the four horizontal side wells are aligned on the axes running between the four vertical corner injection wells.

Formation characteristics and existing vertical wells may require that the pattern be shaped roughly like a quadrilateral without ninety degree angles. Such patterns are intended to be encompassed within the phrase "substantially rectangular pattern".

Figure 1:
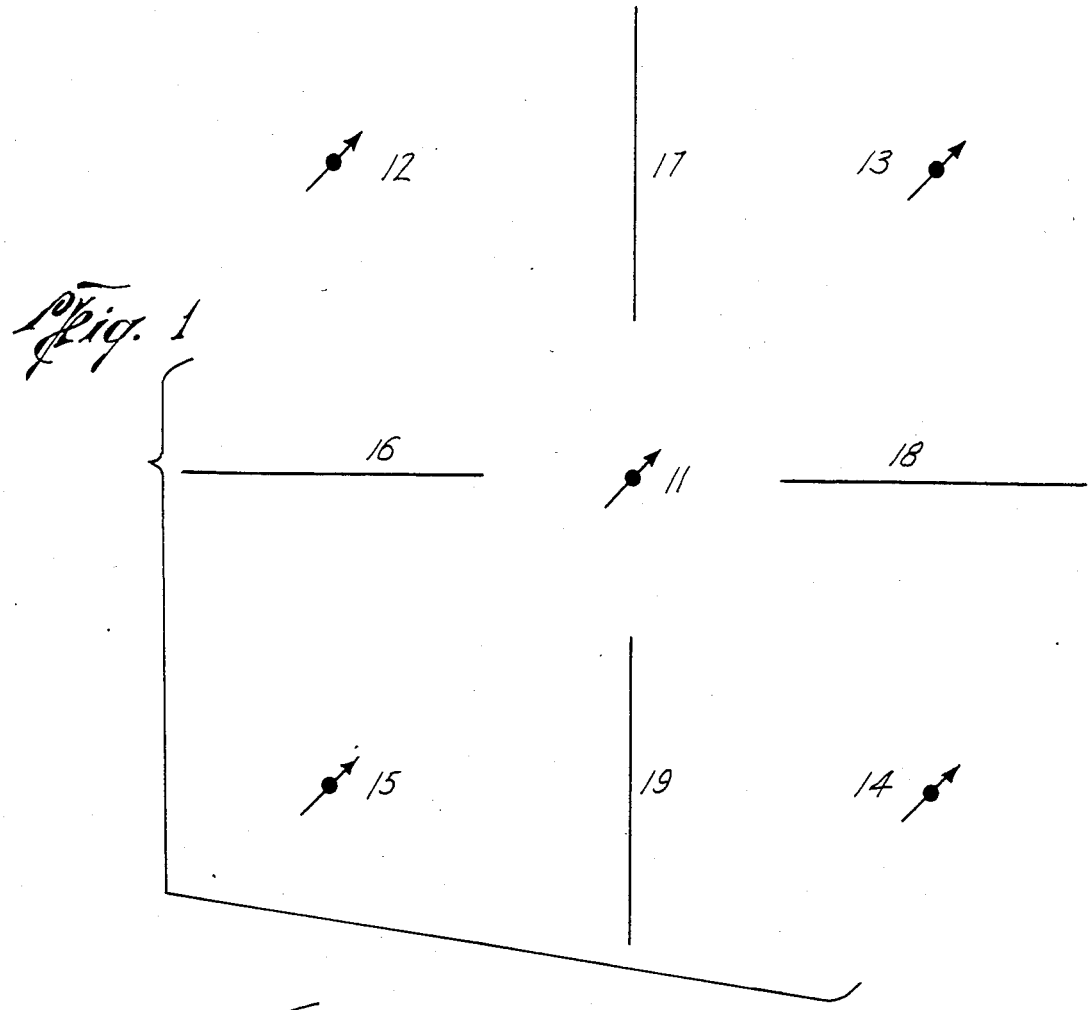
FIG. 1 illustrates an invention well pattern for a modified 9 spot pattern.
Figure 2:
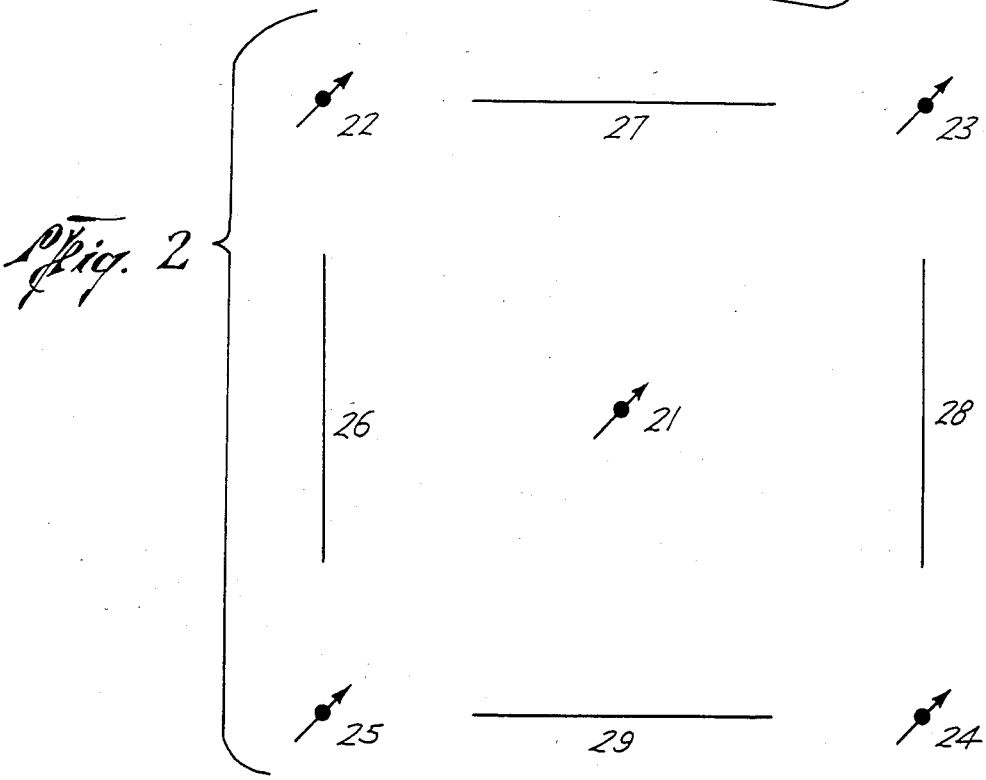
FIG. 2 illustrates another invention well pattern for a modified 9 spot pattern.

When considered as independent 9 spot patterns, these two patterns as illustrated in FIGS. 1 and 2 constitute different patterns. But if either of the patterns of FIGS. 1 and 2 are continued to provide a group of multiple patterns as in a field wide development, the field group of multiple patterns will automatically include both of the invention patterns illustrated in FIGS. 1 and 2.

The substantially vertical central well may be either an injection well or a production well, but is preferably an injection well. The vertical and horizontal wells are preferably completed in the bottom third, most preferably, the bottom fifth of the formation.

The modified 9 spot well patterns of the present invention may be expanded to modified 13 spot patterns by the inclusion of four substantially vertical infill wells located between the central well and each of the four corner injection wells. The infill wells may be either production wells or injection wells or both injection and production wells as the EOR flood progresses. Under some operational procedures, the infill wells may be converted to injection wells as is well known in the art.

FIGS. 1 and 2 diagram the invention drilling and production patterns. FIG. 1 illustrates 9 wells with well 11 being a substantially vertical central injection well, wells 12, 13, 14 and 15 being substantially vertical corner injection wells and wells 16, 17, 18 and 19 being substantially horizontal side production wells. FIG. 2 illustrates the related modified 9 spot pattern, wherein well 21 is the central injection well, wells 22, 23, 24 and 25 are substantially vertical corner injection wells and wells 26, 27, 28 and 29 are substantially horizontal production side wells. For some patterns, particularly patterns covering a large area, it may be desirable to substitute several vertical injection wells for the single central injection well 21 and locate the plural central injectors near the center of the pattern.

Figure 3:
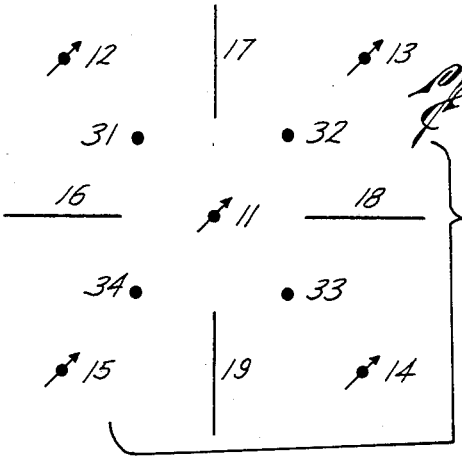
FIGS. 3–10 illustrate additional embodiments of the invention well pattern.
Figure 4:
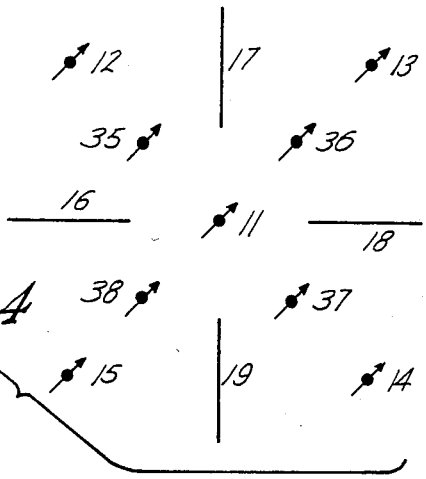

FIGS. 3–10 diagram additional invention drilling and production patterns. FIGS. 3 and 4 are embodiments of the FIG. 1 pattern wherein four infill wells have been located between the central injection well 11 and each of the four corner wells 12, 13, 14 and 15. FIG. 3 shows infill porduction wells 31, 32, 33 and 34. FIG. 4 shows infill injection wells 35, 36, 37 and 38.

Figure 5:
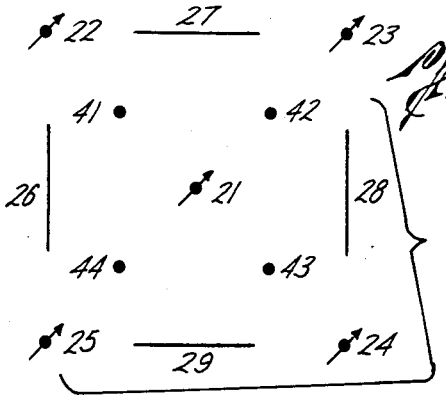
Figure 6:
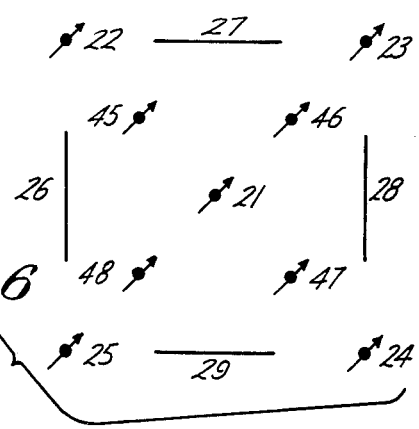

FIGS. 5 and 6 diagram the invention pattern of FIG. 2 with the addition of four infill wells. In FIG. 5, infill production wells 41, 42, 43 and 44 are added to the FIG. 2 embodiment. In FIG. 6, infill injection wells 45, 46, 47 and 48 are located between the central injector 21 and four corner wells 22, 23, 24 and 25.

Figure 7:
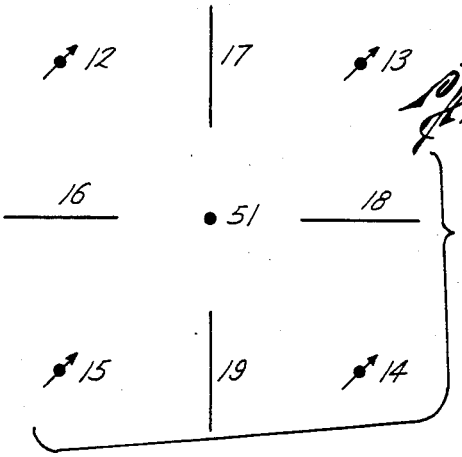
Figure 8:
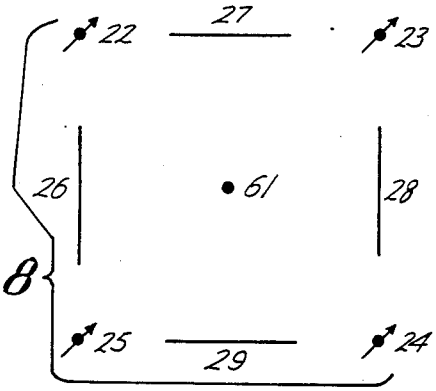

FIG. 7 illustrates an additional embodiment of the FIG. 1 pattern, wherein the central injection well 11 has been replaced with a central production well 51. FIG. 7 has the horizontal wells aligned on axes perpendicular to the substantially rectangular boundaries of the well pattern. FIG. 8 is a modification of the FIG. 2 pattern, wherein the central production well 61 has been substituted for central injection well 21. FIG. 8 has the four horizontal production wells aligned on the axes between the four corner wells.

Figure 9:
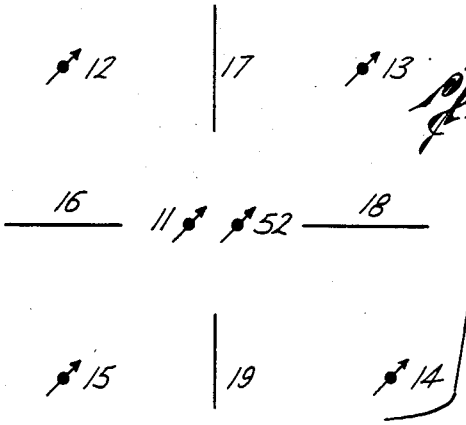
Figure 10:
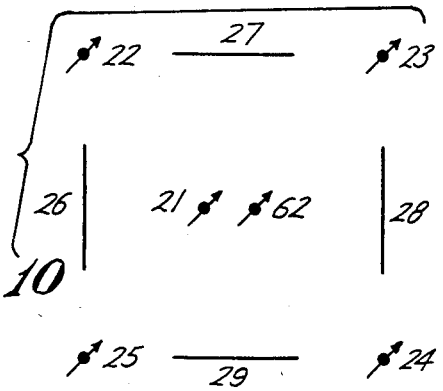

FIG. 9 is a modification of FIG. 1 wherein an additional central injection well 52 has been added to the pattern of FIG. 1. The four horizontal production wells are aligned on axes perpendicular to the substantially rectangular boundaries of the well pattern. FIG. 10 is a modification of the FIG. 2 pattern having horizontal wells aligned on the axes between the four corner wells. In FIG. 10, a second substantially vertical central injection well 62 has been located near the central well 21.

Simulation results indicate that the use of horizontal wells in conjunction with vertical wells according to the invention are highly effective in recovering oil, particularly oil from blind spot areas in mature steam floods. The horizontal wells speed oil recovery and thus, shorten project lives. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells in their perforation intervals are not critical, except that such factors will affect the well spacing and the economics of the process. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific-Software Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9 spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

Infill wells were added to the simulation grid midway between center and corner wells to form an inverted 13 spot pattern. The wells were completed in the lower one-third of the zone only and infill production began after three years of steam injection and continued to the end of the project.

Ultimate recovery was 63.2% of the original oil in place after 11 years. Note that the advantage of infill wells is to recover oil sooner. For the inverted 9 spot pattern of Ex. 1, the oil recovery at 11 years would have been only 57% at this time. Because of the presence of infill wells, oil production which would otherwise arrive at corner and side wells will be reduced. As a result, the inverted 13 spot pattern would reach economic limit much sooner than an inverted 9 spot pattern unless other operational changes are made.

The oil saturation profile for Example 2 is about the same as for Ex. 1, but is reached four years sooner than in Ex. 1. There is still a high oil saturation region in the area between the corner and side wells.

EXAMPLE 3

The modified 9 spot of FIG. 1 was simulated and compared with the base cases of Examples 1 and 2. The number of effective wells per pattern for this configuration is two vertical injectors and two horizontal producers.

The run was carried out by simulating one-eighth of an 18.5 acre (7.5 ha) pattern with a total steam injection rate at the center and corner wells of 3400 BPD (540 $m^3/d$) or 1.5 BPD per acre foot. Vertical wells were completed in the lower three layers of the simulation grid only and all horizontal wells were completed in the bottom (5th layer) of the simulation grid. The horizontal wells had a length of 600 feet and a diameter of 6 inches.

Ultimate recovery was 73.1% of the original oil in place after a project life of 14 years. The total steam injected was 1.8 pore volumes.

After 14 years, a small blind spot area remained along diagonal midway between the central and corner injection wells. Oil saturations in this area ranged from 35% to 40% in the fifth and bottom layer. Such a blind spot was expected and can be cured by the use of infill wells located between the central and corner wells. It is also possible to lower the project's overall steam requirements by converting to water injection from steam injection during the later years of the project.

Many variations of the method of this invention will be apparent to those skilled in the art from the foregoing discussion and examples. Variations can be made without departing from the scope and spirit of the following claims.

TABLE 1

| RESERVOIR AND FLUID PROPERTIES - SIMULATION OF EXAMPLES 1–4 | |
|---|---|
| Porosity, fraction | 0.39 |
| Initial Fluid Saturations, Fraction: | |
| Oil | 0.589 |
| Water | 0.411 |
| Gas | 0 |
| Initial Reservoir Temperature, °F.(°C.) | 100 (37.7) |
| Initial Reservoir Pressure, psi (kPa) | 50 (345) |
| Permeability, md: | |
| Horizontal ($\mu m^2$) | 3000 (3) |
| Vertical ($\mu m^2$) | 900 (0.9) |
| Reservoir Thermal Conductivity, Btu/day-ft-°F. (W/m-°C.) | 31.2 (2.25) |
| Reservoir Heat Capacity, Btu/$ft^3$-°F. (kJ/$m^3$-°C.) | 37.0 (2481) |
| Cap and Base Rock Thermal Conductivity, Btu/day-ft-°F. (W/m-°C.) | 24.0 (1.73) |
| Cap and Base Rock Heat Capacity, Btu/$ft^3$-°F. (kJ/$m^3$-°C.) | 46.0 (3085) |
| Oil Viscosity, cp @ °F. Pa.s @ °C. | |
| 1230 @ 100 1.23 @ 37.7 | |
| 10 @ 300 0.01 @ 148.9 | |
| 3.99 @ 400 0.00399 @ 204.4 | |
| Quality of Injected Steam, fraction (at sand face) | 0.65 |
| Residual Oil Saturation, Fraction | |
| to water: | 0.25 |
| to steam: | 0.15 |

What is claimed is:

1. A modified 9 spot well pattern for recovering hydrocarbons from an underground formation, which comprises:

a substantially vertical central well;

four substantially vertical corner injection wells; and four substantially horizontal wells as the side wells in a modified 9 spot well pattern;

said horizontal side wells aligned on axes perpendicular to the substantially rectangular boundaries of the modified 9 spot well pattern.

2. The pattern of claim 1, wherein the central well is an injection well.

3. The pattern of claim 2, further comprising an additional substantially vertical central injection well.

4. The pattern of claim 1, wherein the central well is a production well.

5. The pattern of claim 1, wherein the horizontal wells are completed in the bottom fifth of the formation.

6. The pattern of claim 1, further comprising four substantially vertical infill wells between the central well and each of the four corner wells.

7. The pattern of claim 6, wherein the infill wells are production wells.

8. The pattern of claim 6, wherein the infill wells are injection wells.

9. A modified 9 spot well pattern for recovering hydrocarbons from an underground formation, which comprises:

a substantially vertical central injection well;

four substantially vertical corner injection wells; and four substantially horizontal production wells as the side wells in a modified 9 spot well pattern, said horizontal wells completed in the bottom fifth of the formation and aligned on axes perpendicular to the substantially rectangular boundaries of the modified 9 spot well pattern.

10. A modified 9 spot well pattern for recovering hydrocarbons from an underground formation, which comprises:

a substantially vertical central well;

four substantially vertical corner injection wells; and four substantially horizontal wells as the side wells in a modified 9 spot well pattern, said horizontal side wells aligned on the axes between the four corner wells.

11. The pattern of claim 10, wherein the central well is an injection well.

12. The pattern of claim 11, further comprising an additional substantially vertical central injection well.

13. The pattern of claim 10, wherein the central well is a production well.

14. The pattern of claim 10, wherein the horizontal wells are completed in the bottom fifth of the formation.

15. The pattern of claim 10, further comprising four substantially vertical infill wells between the central well and each of the four corner wells.

16. The pattern of claim 15, wherein the infill wells are production wells.

17. The pattern of claim 15, wherein the infill wells are injection wells.

18. A modified 9 spot well pattern for recovering hydrocarbons from an underground formation, which comprises:

a substantially vertical central injection well;

four substantially vertical corner injection wells; and four substantially horizontal production wells as the side wells in a modified 9 spot well pattern, said horizontal wells completed in the bottom fifth of the formation and aligned on the axes between the four corner wells.

* * * * *